US009102463B2

(12) United States Patent
Osterloh et al.

(10) Patent No.: US 9,102,463 B2
(45) Date of Patent: Aug. 11, 2015

(54) METHOD FOR FILLING A CAVITY, IN PARTICULAR A BLISTER OF A BLISTER PACKAGING, WITH A LIQUID, AND SEMIFINISHED PRODUCT FOR USE IN SUCH A METHOD

(75) Inventors: Dirk Osterloh, Unna (DE); Berthold Lange, Werne (DE)

(73) Assignee: Boehringer Ingelheim MicroParts GmbH, Dortmund (DE)

( * ) Notice: Subject to any disclaimer, the term of this patent is extended or adjusted under 35 U.S.C. 154(b) by 64 days.

(21) Appl. No.: 13/991,810

(22) PCT Filed: Dec. 12, 2011

(86) PCT No.: PCT/EP2011/072487

§ 371 (c)(1),
(2), (4) Date: Aug. 15, 2013

(87) PCT Pub. No.: WO2012/080190

PCT Pub. Date: Jun. 21, 2012

(65) Prior Publication Data

US 2014/0131247 A1 May 15, 2014

(30) Foreign Application Priority Data

Dec. 16, 2010 (EP) ..... 10195419

(51) Int. Cl.
*B65B 3/24* (2006.01)
*B65B 11/50* (2006.01)
(Continued)

(52) U.S. Cl.
CPC . *B65D 85/70* (2013.01); *B65B 3/24* (2013.01); *B65B 11/50* (2013.01); *B65B 3/26* (2013.01)

(58) Field of Classification Search
CPC ..... B65B 3/02; B65B 3/022; B65B 3/24; B65B 3/26; B65B 9/042; B65B 11/50; B65B 11/52; B65B 47/00; B65B 61/24; B65B 2230/02; B65D 85/70
USPC ..... 53/453, 467, 471, 559, 246, 281; 141/324; 206/525, 219
See application file for complete search history.

(56) References Cited

U.S. PATENT DOCUMENTS 4,565,052 A * 1/1986 Hautemont ..... 53/453
4,753,352 A 6/1988 Dauphin
(Continued)

FOREIGN PATENT DOCUMENTS

EP 0960825 A2 12/1999
EP 2 243 715 A1 10/2010
(Continued)

OTHER PUBLICATIONS

International Search Report and Written Opinion for corresponding application PCT/EP2011/072487, dated Feb. 29, 2012.

*Primary Examiner* — Stephen F Gerrity
*Assistant Examiner* — Joy N Sanders
(74) *Attorney, Agent, or Firm* — Michael P. Morris; Mary-Ellen M. Devlin

(57) ABSTRACT

Methods and apparatus provide for filling at least one cavity with a liquid via: partly filling a cavity of a semifinished product containing at least two cavities, covering the semifinished product at least in some areas, so as to prevent the escape of liquid from the semifinished product, displacing at least some of the liquid from the already partially filled cavity, such that at least one other cavity is completely filled by a portion of the displaced liquid and another portion of the displaced liquid at least partially fills at least one overflow.

10 Claims, 3 Drawing Sheets

Figure 1:
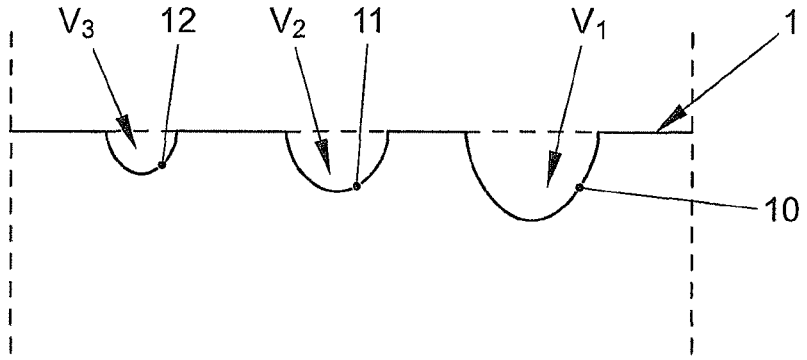

(51) Int. Cl.
*B65D 85/00* (2006.01)
*B65B 3/26* (2006.01)

(56) References Cited

U.S. PATENT DOCUMENTS

2010/0308051 A1* 12/2010 Weber ..... 220/266
2011/0186466 A1* 8/2011 Kurowski et al. ..... 206/524.6
2014/0131247 A1 5/2014 Osterloh

FOREIGN PATENT DOCUMENTS

FR 2 528 386 A1 12/1983
FR 2 593 152 A1 7/1987
WO 0248002 A2 6/2002
WO 2012080190 A1 6/2012

* cited by examiner

METHOD FOR FILLING A CAVITY, IN PARTICULAR A BLISTER OF A BLISTER PACKAGING, WITH A LIQUID, AND SEMIFINISHED PRODUCT FOR USE IN SUCH A METHOD

Method for filling a cavity, in particular a blister of a blister packaging, with a liquid, and semifinished product for use in such a method.

The invention relates to a method for filling at least one cavity, in particular a blister of a blister packaging, with a liquid.

The filling of one or more cavities with materials, solid items or liquids is known for example from the field of so-called display packaging or blister packaging. Blister packs are used in different fields and industrial sectors and are provided with at least one cavity into which the contents that are to be packaged therein are placed. As a rule the contents of the cavity or cavities are visible from outside. Blister packs therefore have the advantage that they can be used as retail packaging.

In the pharmaceutical or medical sector, blister packs are used for packaging pharmaceutical formulations, tablets, capsules or other forms of medicaments and serve to protect them from external environmental influences which may in some circumstances adversely affect the pharmaceutical quality of the formulation.

Typical blister packs consist of at least two films which may in turn be composed of a plurality of layers of different or identical materials. These are, on the one hand, a base layer or base film and on the other hand a cover layer or cover film.

One or more wells may be formed in the base film into which the pharmaceutical formulation, tablet or capsule is placed or added. The cover film is then placed on top of the base film and fixed to it, this fixing being carried out for example at the edges by adhesive bonding, heat-sealing, welding or the like. The films are generally made of plastics or metal (e.g. aluminium); in principle, other materials such as paper may be used in the same way or in addition.

DE 103 43 668 A1 shows one possible structure and a possible method of producing a blister pack for medicaments. This is known to the skilled man and therefore need not be described in detail here.

DE 20 2007 003 050 U1 discloses a blister packaging which is filled with an active substance in liquid or gel form. The active substance is supposed to be released into the environment by diffusion. Possible applications include for example room deodorisers or air fresheners, insect repellents, toilet deodorisers, etc. Paragraph 0004 of this specification mentions that a problem arises if the container is no longer completely full after a certain period of use. The specification therefore obviously starts from the premise of total filling of the cavity of the blister pack with liquid or gel. However, the skilled man is not provided with any instruction as to how to achieve total filling, particularly free from air bubbles, in a reliable manner. The solution to this problem is not a task that is addressed by the specification and is of no further significance to the function of the invention described in this specification.

However, there may be instances where the total filling of a cavity with liquid, particularly the blister of a blister pack, with liquid is absolutely essential. This circumstance may arise, for example, if a blister pack is mounted on a medical technical cartridge (for example, a biosensor) and the liquid contained in the cavity of the blister pack and provided with reagents is intended to trigger a certain analytical reaction at specific points in the cartridge. The cartridge will usually contain a microfluidic system. To ensure that a desired analytical reaction using the liquid is not falsified or influenced, it may be necessary, after the cavity of the blister pack has been opened, for example, by means of a mechanism of the cartridge, for the liquid to be transferred onto the cartridge without any air bubbles. In addition to other measures that technically still have to be carried out in the mechanisms of the cartridge, this presupposes at least that the cavity of the blister pack itself is totally filled with liquid, i.e., with no air bubbles.

The invention is based on the problem of providing a method that allows total filling of a cavity, particularly a blister of a blister packaging, with liquid.

This problem is solved by the features of claim 1.

The invention provides a method for filling at least one cavity, particularly a blister of a blister packaging, with a liquid, comprising at least the following steps:

- partially filling a cavity of a semifinished product containing at least two cavities, with the liquid,
- covering the semifinished product, at least in some areas, such that liquid is prevented from escaping from the semifinished product,
- displacing at least some of the liquid from the already partially filled cavity such that at least one other cavity is completely filled with some of the displaced liquid and at least one other portion of the displaced liquid at least partially fills at least one overflow.

This process makes it possible to fill at least one cavity completely with no air bubbles in a very reliable and dependable manner. Thus, initially only a first cavity needs to be partially filled with liquid, which is technically very easy to do. Moreover, the partial filling has the advantage that during transporting between corresponding stations of a manufacturing plant the liquid cannot escape so easily from the partially filled cavity and contaminate the environment or manufacturing plant.

After the semifinished product, for example, the base film of a blister packaging, has been covered, liquid is no longer able to escape. The semifinished product is thus prepared or "packaged" ready for the subsequent treatment step and can be delivered to the next step of the above-mentioned displacement process immediately or later on. The semifinished product can be stored or transported onwards without any risk of the liquid escaping from it.

The displacement of at least some of the liquid from the already partially filled cavity, which takes place in another process step, then leads to a cooperation of the at least two cavities such that finally one cavity is filled completely (with no air inclusion). Because of the fluidic interaction of the cavities and the overflow, the initially partly filled cavity can be regarded as a kind of "filling cavity", while the at least one other, completely filled cavity can be termed a kind of "functional cavity". The at least one overflow that is to be provided may itself also be embodied, for example, as a cavity in the manner of the other cavities. This cavity, which receives some of the displaced liquid and is at least partially filled, can then virtually be termed an "overflow cavity". After other possible steps that are still to be described, the "functional cavity" may be delivered to its intended destination or its intended function, for example, in a medical technical cartridge.

It is very expedient to design the method so that the fill volume of the liquid in the initially partly filled cavity is such that, even if this liquid is only partly displaced from the initially partly filled cavity, the at least one other cavity is completely filled and the at least one overflow is at least partly filled. In fact, there is a chance that during the displacement of the liquid from the initially partly filled cavity the liquid will be displaced not completely but only partially, with the result that some residual liquid remains in the initially partly filled cavity. However, it should be possible to completely fill the at least one other cavity and to at least partly fill the at least one overflow with excess liquid. For this purpose, as a rule, the volume of the initially partially filled cavity is chosen to be significantly greater than the volume of the cavity that is to be filled completely. The reliability of the method according to the invention is thereby enhanced.

According to another advantageous embodiment of the inventive concept, the covering of the semifinished product is carried out so as to prevent liquid from escaping from the semifinished product and to ensure that a liquid transfer or exchange between the cavities takes place only when a specific pressure is applied. This enables the covered semifinished product to be stored or transported without the liquid that has already been placed in the first cavity getting into another cavity prematurely, i.e., before further treatment (displacement of the liquid from the already partially filled cavity). The skilled man will in any case provide a fluidic connection between the at least two cavities mentioned, but the reliability of the process can be further increased by this embodiment of the invention, as any premature transfer of liquid between the cavities could cause this process to be adversely affected under certain circumstances. The pressure to be applied in order to achieve a transfer of liquid between the cavities is understandably designed, by suitable dimensioning (for example, by the arrangement of fluidic "valves" between the cavities), such that this leads only to a transfer of liquid between the cavities, but not to an escape of liquid from the semifinished product.

The displacement of at least some of the liquid from the already partially filled cavity may be carried out in various ways. For example, it is possible to aspirate the liquid out of the partially filled cavity by the application of a negative pressure or to pump it out by the application of a positive pressure. However, it has proved very simple, in terms of the technical equipment used in the process, if the displacement is carried out by deformation of the cavity. The deformation of the cavity can advantageously be done using a punch-like tool.

It has proved very expedient for the semifinished product to be aligned with its planar expanse substantially vertical, at least during the deformation of the cavity, with the cavity that is to be deformed being positioned at the bottom, in relation to the at least one other cavity and the at least one overflow. As a result, during the deformation, the air in the partially filled cavity can be driven upwards particularly easily before the column of liquid and is able to escape through a suitable venting device.

Expediently, a vent opening should only be formed in the cover of the semifinished product immediately before the deformation of the cavity, so as to ensure that the system is closed off to the outside as much as possible before the step of displacement (deformation).

According to a further feature of the invention, after the deformation of the cavity and total filling of the at least one other cavity, the at least one other cavity is closed off in fluidtight manner and expediently separated from the other cavities or from the overflow after the cavity has been sealed off in fluidtight manner. The totally filled cavity ("functional cavity") is thus available as a transportable and storable end product and can in due course be delivered to its intended location or its intended function.

Standard machinery for the manufacture of blister packaging, for example, produces the cavities in films by thermoforming. It is therefore advantageous for the cavities to be formed in the semifinished product by thermoforming. Thus at least the production of the semifinished product can be carried out using inexpensive standard machinery.

According to another embodiment of the process it is provided that, after the thermoforming, holes are formed in the semifinished product. Such holes may serve, for example, as positioning holes, in the event that individual semifinished products containing, for example, at least two cavities and at least one overflow are to be machined. However, they may also act as transporting holes if, for example, the semifinished product is configured as an endless strip with a plurality of "individual semifinished products" (as mentioned previously) aligned with one another.

However, the invention relates not only to a method as described above but also to a semifinished product which is particularly suitable for use in such a method.

According to the invention the semifinished product is embodied as a film, at least in parts, and comprises at least two cavities having a first volume and a second volume, respectively, the volumes being of different sizes.

As a result of the film-like configuration of the semifinished product, the cavities may be produced very easily by thermoforming on standard machinery, particularly that used for blister packaging. The different sizes of the cavities are an essential prerequisite to enable the effect of displacement described in relation to the method according to the invention, namely complete filling of a cavity, to take place.

Tests have shown that it is very expedient to make the volume of the first cavity roughly 50 to 150 percent, preferably about 100 percent, greater than the volume of the at least one second cavity.

It is also possible to provide a semifinished product which is already covered, at least in some areas, so that it is impossible for liquid to escape from the semifinished product and the transfer of liquid between the cavities is only possible by the application of a specific pressure. This naturally presupposes that the semifinished product or the at least one first cavity is already partly filled with liquid. A semifinished product prepared in this way could, for example, be obtained from a supplier or produced in-house beforehand and stored intermediately and would then only have to be subjected to the further processing steps. The level of pressure to be applied could be pre-determined, for example, by the dimensions of suitable valve-like breaks in a channel-like region located between the cavities. This ensures that there is no unintentional transfer of liquid between the cavities before the further processing steps are carried out.

The semifinished product may, for example, advantageously be covered, at least in some areas, such that at least one channel-like region is left between the cavities which is interrupted at certain points and the at least one second cavity is connected to at least one overflow.

Expediently, the at least one overflow may be embodied as a further cavity in the manner of the other cavities. In this case, the cavity acting as an overflow may already have been formed in the semifinished product with the other cavities by thermoforming and it is expedient to connect the additional cavity to the cavity that is to be filled completely by means of at least one fluidic channel and to provide it with a vent. The at least one overflow may, however, also be differently configured, for example, purely in the form of a channel, in which case a suitable vent would have to be provided in the channel-like overflow itself.

Figure 4:
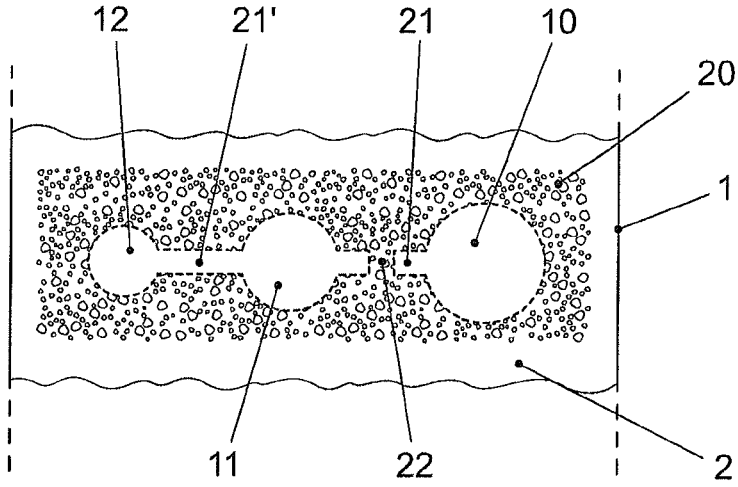
Figure 5:
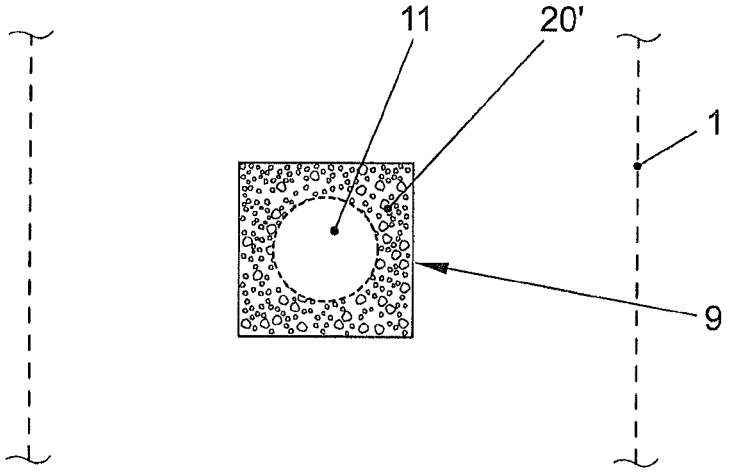

Further advantages and features of the invention will become apparent from embodiments described by way of example, as will be explained in more detail with the aid of the attached Figures. In the drawings FIG. 1 shows a diagrammatic representation of a possible semifinished product in cross-sectional view, FIG. 2 shows the semifinished product according to FIG. 1 in plan view, FIG. 3*a* to *f* are diagrammatic representations of different steps of the method according to a preferred embodiment of the method according to the invention, viewed as in FIG. 1, FIG. 4 is a diagrammatic representation of the semifinished product further processed in a step of the method according to the invention, and FIG. 5 is a diagrammatic plan view of an end product produced by the method according to the invention, in the form of a blister packaging with a totally filled blister.

Figure 2:
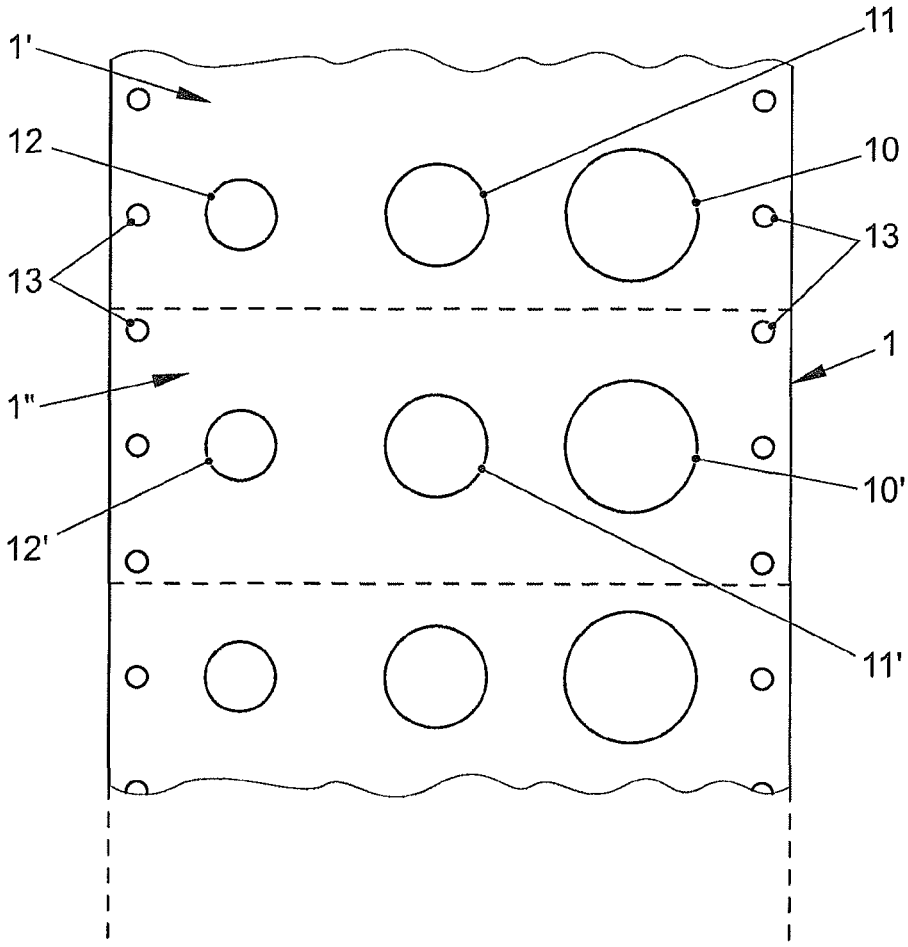

First of all, reference is made to FIGS. 1 and 2. These show a film-like semifinished product 1 in the form of a continuous strip that comprises, transversely of its longitudinal extent, three cavities 10, 11 and 12 with volumes V1, V2 and V3, respectively. The volume V1 of the first cavity 10 is about 50 to 150 percent, preferably about 100 percent, larger than the volume V2 of the second cavity 11. The volume V3 of the third cavity 12, however, only has to be selected so that the cavity 12 can easily receive excess liquid F (cf. also FIG. 3*d*). Thus, the volume V3 of the cavity 12 may, for example, be roughly 40 to 60 percent, preferably about 50 percent smaller than the volume V2 of the second cavity 11.

According to the embodiment of the film-like semifinished product 1 as a continuous strip, a plurality of areas arranged one behind the other, each with three cavities 10 to 12 or 10' to 12', etc., may be seen. In addition, transporting holes 13 may be seen along the outer edge regions of the continuous strip. However, it would be possible to process the respective areas (indicated by dashed transverse lines) as individual semifinished products 1', 1", etc., while the holes 13 could act as positioning holes.

FIGS. 3*a* to 3*f* illustrate in more detail a preferred embodiment of a method according to the invention. Manufacturing equipment is shown only where it contributes to the understanding of the invention.

In a first step S1 (FIG. 3*a*) the first cavity 10 is filled with a liquid F containing reagents, to a fill volume VB1, which is less than the volume V1 of this cavity. This results in partial filling, so that an unfilled residual volume VR1 remains in the cavity 10. In this Figure are also shown the positioning or transporting holes 13. The filling process was carried out from above and is not shown here as it is not essential to the understanding of the invention. It may be carried out with a suitable tool, for example, with a pipette or the like.

In another step S2 (FIG. 3*b*) a cover film 2 is placed on the semifinished product 1 and a first sealing tool 3 (indicated by dashed lines) is advanced vertically towards the cover film 2. The sealing tool 3 takes account of a channel structure that is to be produced, which will be explained in more detail with reference to FIG. 4. For this purpose it therefore comprises recesses 30 or projections 31, which cause only certain areas of the cover film 2 to be attached to the film-like semifinished product 1, while others are not. Thus, after the heat-sealing, channel-like unsealed regions 21 and 21' are formed between the cavities 10 and 11, and 11 and 12, respectively. In these channel-like unsealed regions 21 and 21' the cover film 2 thus merely rests on the film-like semi-finished product 1 and is not attached thereto, which means that the transfer or passage of liquid can take place in the regions 21 and 21'. It should be pointed out that the thickness of the cover film 2 in the schematic representations is shown on an exaggerated scale compared with the film-like semifinished product 1, for greater clarity.

As can be seen from FIG. 4, the heat-sealing creates around the cavities 10 to 12 an extensively sealed region 20 (indicated by dots), leaving the channel-like unsealed regions 21 and 21' between the cavities 10 and 11 and 11 and 12, respectively. In addition, a sealed, strip-like region 22, produced by the projection 31 of the sealing tool 3, can be seen between the cavities 10 and 11. This region 22 is of such dimensions that under normal circumstances (i.e., during transport and storage) it is not possible for the liquid F contained in the cavity 10 to pass through the channel-like region 21. Similarly, the extensively sealed region 20 constitutes a fluidtight connection of the cover film 2 to the film-like semifinished product 1. Only when the pressure on the sealed, strip-like region 22 is increased (for example, by deformation of the first cavity 10, cf. also FIG. 3*d*) can the sealed strip-like region 22 be penetrated. The region 22 thus acts as a virtual flow valve and can be made of a size to suit the particular requirements.

The covering of the semifinished product 1 with the cover film 2 as described and the desired fluidtight connection can be achieved by conventional methods such as heat-sealing, adhesion, welding or the like.

In another step S3 (FIG. 3*c*) a vent opening 14 is formed in the cover film 2, above the third cavity 12, by means of a pin-like perforating tool 4.

This is followed by another step S4 (FIG. 3*d*) in which the first cavity 10 is deformed by means of a punch-like tool 5. Specifically, the punch-like tool 5 travels in controlled manner from the side of the semifinished product 1 remote from the cover film 2 into the first cavity 10. In controlled manner means that this introduction does not damage the cavity 10 but only deforms it. As a result of the deformation of the cavity 10 a large proportion of the liquid F contained therein as well as air is forced through the channel-like region 21 or towards the sealed strip-like region 22, as a result of which the region 22 is opened up like a valve and the liquid F passes into the second cavity 11. It is clear that in spite of the deformation of the first cavity 10 a residual fill volume VBR1 remains in the first cavity 10, and also a certain air inclusion L. In spite of this generally unavoidable residual fill volume VBR1 in the first cavity 10, the second cavity 11 is filled with a fill volume VB2 of liquid F which substantially corresponds to V2 in its volume. Thus the second cavity 11 is filled completely (with no air inclusion). As already mentioned, the first cavity 10 is significantly larger than the second cavity 11 in the embodiment shown and the chosen fill volume VB1 of the first cavity 10 (roughly 60 percent of the volume V1) roughly corresponds to 120 to 150 percent of the volume V2 of the second cavity 11. Such dimensions, in addition to totally filling the cavity 11, are sufficient to fill the third cavity 12 with a fill volume VB3 which is smaller than the volume V3 of the third cavity 12. This produces an unfilled residual volume VR3 of the third cavity 12. The third cavity 12 thus acts as an overflow for the second cavity 11 and is readily able to hold the excess liquid F that cannot be contained by the cavity 11. The air driven out in advance of the liquid front as the liquid F is displaced is able to escape through the vent opening provided beforehand.

Figure 3A:
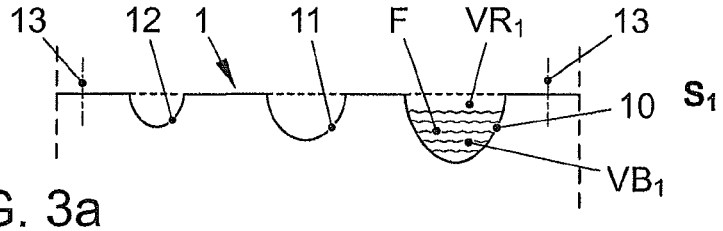
Figure 3B:
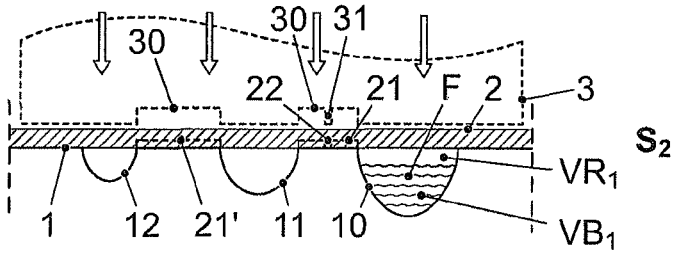
Figure 3C:
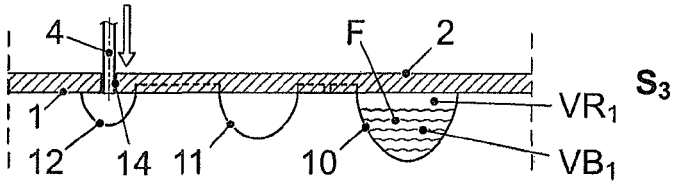
Figure 3D:
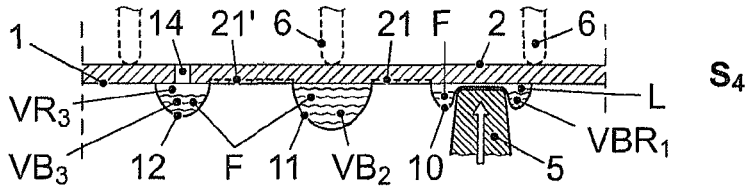
Figure 3E:
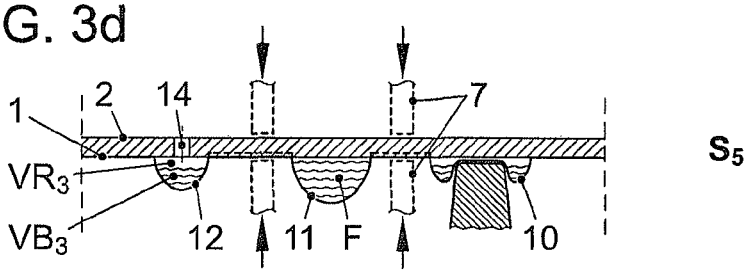
Figure 3F:
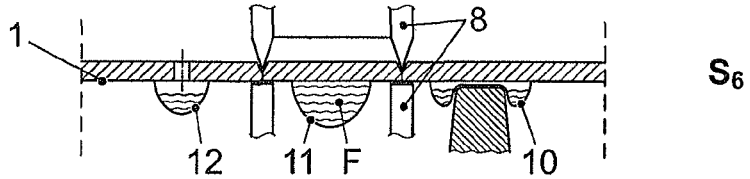

It should be pointed out that in FIG. 3*d* the surface alignment of the film-like semifinished product 1 is shown as being substantially horizontal, but tests have shown that for step S4 it is advantageous to align the surface of the film-like semifinished product 1 substantially vertically, with the first cavity 10 at the bottom. The result of this is that during the deformation of the cavity 10 the enclosed air can very easily be driven upwards in advance of the liquid front, penetrate the region 22 and reach the vent opening 14. In addition, the possible use of braces 6 is indicated by dashed lines.

It should be pointed out that in the embodiment shown the third cavity 12 does indeed act as an "overflow cavity", but the embodiment of an overflow does not necessarily have to be in the manner of the cavity 12. The function of an overflow could be provided by the channel-like region 21' adjoining the second cavity 11 and provided with a corresponding vent opening. Other forms of overflow are also possible. During the deformation, excess liquid F should be able to escape unimpeded from the second cavity 11 into the overflow. The embodiment of the overflow in the manner of the cavity 12 does, however, have the advantage that it is able to hold a comparatively large amount of excess liquid F and the risk of liquid F accidentally escaping outwards from the overflow (soiling/contamination of the environment) is avoided.

In another step S5 (FIG. 3*e*), i.e., after the cavity 11 has already been completely filled with liquid F, it may be envisaged that a second sealing tool 7 (shown by dashed lines) is advanced towards the cover film 2 or the film-like semifinished product 1 so that the existing channel-like regions 21 and 21' can be sealed again in fluidtight manner.

In another step S6 (FIG. 3*f*) it may also be envisaged that the cavity 11, that has been completely filled with liquid F and finally closed off by sealing, may be severed by means of a suitable cutting tool 8, i.e., separated from the cavities 10 and 12. This may be done, for example, so as to produce an end product 9 which is substantially square in plan view, as shown in FIG. 5. In the embodiment shown, the end product 9 is an individual blister packaging which comprises a cavity 11 (blister) totally filled with liquid. The cavity 11 is provided with a sealed region 20' surrounding it on all sides. Of course, the end product 9 may naturally also take other forms, for example, a plurality of completely filled cavities 11, 11' etc., if a correspondingly different form of separation has been carried out in the previous steps.

The end product 9 produced may be used in a microfluidic or medical-technical cartridge, for example, at a later time, as already mentioned.

LIST OF REFERENCE NUMERALS

1, 1', 1" film-like semifinished product
10, 10' first cavity
11, 11' second cavity
12, 12' third cavity
13 positioning or transporting holes
14 vent opening
2 cover film
20, 20' extensively sealed region
21, 21' channel-like unsealed regions
22 sealed, strip-like regions
3 first sealing tool
30 recesses
31 projections
4 perforating tool
5 punch-like tool
6 brace
7 second sealing tool
8 cutting tool
9 end product
V1 volume of the first cavity
V2 volume of the second cavity
V3 volume of the third cavity
VB1 fill volume of the first cavity
VB2 fill volume of the second cavity
VB3 fill volume of the third cavity
VBR1 residual fill volume of the first cavity
VR1 unfilled residual volume of the first cavity
VR3 residual fill volume of the third cavity
L air inclusion
S1-S6 method steps
F liquid

The invention claimed is:

1. A method for filling at least one cavity (11) with a liquid (F), comprising the following steps:

partly filling (S1) a first cavity (10) of a semi-finished product (1) containing at least two cavities (10, 11) with the liquid (F) such that an adjacent second cavity (11) is not filled with the liquid, covering (S2) the semi-finished product (1) in some areas with a cover, such that the first cavity (10) is completely sealed so as to prevent the escape of liquid (F) from the first cavity (10), displacing (S4) at least some of the liquid (F) from the already partially filled cavity (10), such that a pressure within the first cavity (10) increases sufficiently to break the seal on the first cavity (10) and permit the liquid from the first cavity (10) to flow into the second cavity (11), such that the second cavity becomes completely filled by a portion (VB2) of the displaced liquid, and another portion (VB3) of the displaced liquid (F) partially fills one overflow (12) in the semi-finished product.

2. The method according to claim 1, wherein the fill volume (VB1) of the liquid (F) in the initially filled first cavity (10) is chosen such that even if the liquid (F) is only partially displaced from the initially filled cavity (10), the second cavity (11) is completely filled and the overflow (12) is partially filled.

3. The method according to claim 1, wherein the displacing (S4) of at least some of the liquid (F) from the initially filled first cavity (10) is carried out by deformation of the first cavity (10).

4. The method according to claim 3, wherein the deformation of the first cavity (10) is carried out by means of a punch-like tool (5).

5. The method according to claim 3, wherein at least during the deformation of the first cavity (10), the semi-finished product (1) is aligned with its surface expanse substantially vertical, the first cavity (10) that is to be deformed is positioned at a bottom thereof in relation to the second cavity (11) and the one overflow (12).

6. The method according to claim 3, wherein immediately before the deformation of the first cavity (10), a vent opening (14) is formed in the cover (2) of the semi-finished product (1).

7. The method according to claim 3, wherein after the deformation of the first cavity (10) and the complete filling (VB2) of the second cavity (11), the second cavity (11) is sealed off in fluidtight manner (S5).

8. The method according to claim 7, wherein after the second cavity (11) has been sealed off (S5) in fluidtight manner, the second cavity (11) is separated from at least one of the first cavity (10) and the overflow (12).

9. The method according to claim 1, wherein the first and second cavities (10)(11), and the overflow (12) are formed in the semi-finished product (1) by thermoforming.

10. The method according to claim 1, wherein thermoforming holes (13) are formed in the semifinished product (1).

* * * * *